US007490653B2

(12) United States Patent
Ying

(10) Patent No.: US 7,490,653 B2
(45) Date of Patent: Feb. 17, 2009

(54) DOOR AND WINDOW ORNAMENTAL ARTICLE POSITIONING DEVICE

(75) Inventor: Liang Wen Ying, Changhua Hsien (TW)

(73) Assignee: Ching Feng Home Fashions Co., Ltd., Changhua Hsien (TW)

( * ) Notice: Subject to any disclaimer, the term of this patent is extended or adjusted under 35 U.S.C. 154(b) by 166 days.

(21) Appl. No.: 11/449,718

(22) Filed: Jun. 9, 2006

(65) Prior Publication Data

US 2007/0284056 A1 Dec. 13, 2007

(51) Int. Cl.
*E06B 9/48* (2006.01)

(52) U.S. Cl. ..... 160/84.07; 160/134

(58) Field of Classification Search ..... 160/84.07, 160/84.06, 134; 248/262
See application file for complete search history.

(56) References Cited

U.S. PATENT DOCUMENTS 4,224,974 A * 9/1980 Anderson et al. ..... 160/178.1 R
5,002,112 A * 3/1991 Schnebly et al. ..... 160/84.07
6,341,447 B1 * 1/2002 Jean ..... 49/74.1

* cited by examiner

*Primary Examiner*—Blair M. Johnson
(74) *Attorney, Agent, or Firm*—Troxell Law Office PLLC

(57) ABSTRACT

A door and window ornamental article positioning device includes a support unit equipped with stop plates and a support mount to be mounted to a central hollow-out portion of a fan-shaped blind body having a counterweight board fixedly attached to the underside of both end sides respectively. The stop plates and the support mount are respectively provided with connecting portions and coupling cavities to be joined to each other with a restricting space formed for the positioning of the fan-shaped blind body therein. The support mount has an arcutate support portion precisely abutting against the hollow-out portion, and wing panels with insert hooks extending at both external sides to engage with insert pieces of the counterweight boards. Via the separate design, the support unit can have a proper support mount assembled thereto to fit to various diameters of the fan-shaped blind body and stably position the central hollow-out portion thereby.

8 Claims, 8 Drawing Sheets

DOOR AND WINDOW ORNAMENTAL ARTICLE POSITIONING DEVICE

BACKGROUND OF THE INVENTION

The present invention relates to a door and window ornamental article positioning device, comprising a support unit equipped with stop plates detachably engaged with a support mount; whereby, via the separate design thereof, an arcuate support portion of the support mount can be individually processed to fit to various circumferential sizes of a central hollow-out portion of a fan-shaped blind body, permitting the support unit to have a proper support mount flexibly assembled thereto so as to position the central hollow-out portion of the fan-shaped blind body stably in place without the risk of collapsing downwards, maintaining beautiful appearance of the fan-shaped blind body thereby.

Please refer to FIG. 1 showing an exploded perspective view of a conventional door/window ornamental article positioning structure (accompanied by FIG. 2). The conventional door/window ornamental article positioning structure includes a support mount 11 fixedly attached to the top central position of a door/window frame 10. The support mount 11 is integrally molded into one unit, having an arcuate support portion 111 protruding in the middle thereon to retain in place a central hollow-out portion 121 of a fan-shaped ornamental article 12 thereby. In addition, the support mount 11 also includes a set of fan-shaped stop plates 112 symmetrically extending at both sides thereon to restrict the fan-shaped blind body 12 positioned between both stop plates 112. Then, the underside of the support mount 11 and the fan-shaped blind body 12 are adhered onto the top surface of the door/window frame 10 via double-sided adhesive tapes or fastening agent thereof.

There are some drawbacks to the conventional fan-shaped ornamental article positioning structure. Most of all, the support mount 11 is integrally molded into one unit with the arcuate support portion 111 fixed into a certain circumferential size thereby. In case the hollow-out portion 121 of the fan-shaped blind body 12 has a circumferential size unfit to that of the arcuate support portion 111, the arcuate support portion 111 will fail to accurately retain the hollow-out portion 121 in place, and a gap A will reveal there-between as shown in FIG. 2. Over long time of application, the hollow-out portion 121 affected by the gravitational force of the fan-shaped blind body 12 will cave in to the gap A and, thus, destroy the beautiful appearance of the fan-shaped blind body 12 as a whole.

SUMMARY OF THE PRESENT INVENTION

It is, therefore, the primary purpose of the present invention to provide a door and window ornamental article positioning device, comprising a support unit equipped with stop plates detachably engaged with a support mount; whereby, via the separate design thereof, an arcuate support portion of the support mount can be individually processed to fit to various circumferential sizes of a central hollow-out portion of a fan-shaped blind body, permitting the support unit to have a proper support mount flexibly assembled thereto to correspond to the diameter of the fan-shaped blind body so as to position the central hollow-out portion stably in place without the danger of collapsing downwards, maintaining the beautiful appearance of the fan-shaped blind body as a whole thereby.

It is, therefore, the second purpose of the present invention to provide a door and window ornamental article positioning device wherein the support mount has a set of wing panels with inert hooks symmetrically extending at both lateral sides thereon to fit to counterweight boards attached to the underside of the fan-shaped blind body so that the counterweight boards are easily guided along the insert hooks and forced downwards to position the fan-shaped blind body between the two stop plates for location thereby, facilitating a convenient and speedy assembly thereby.

DETAILED DESCRIPTION OF THE PREFERRED EMBODIMENTS

Figure 1:
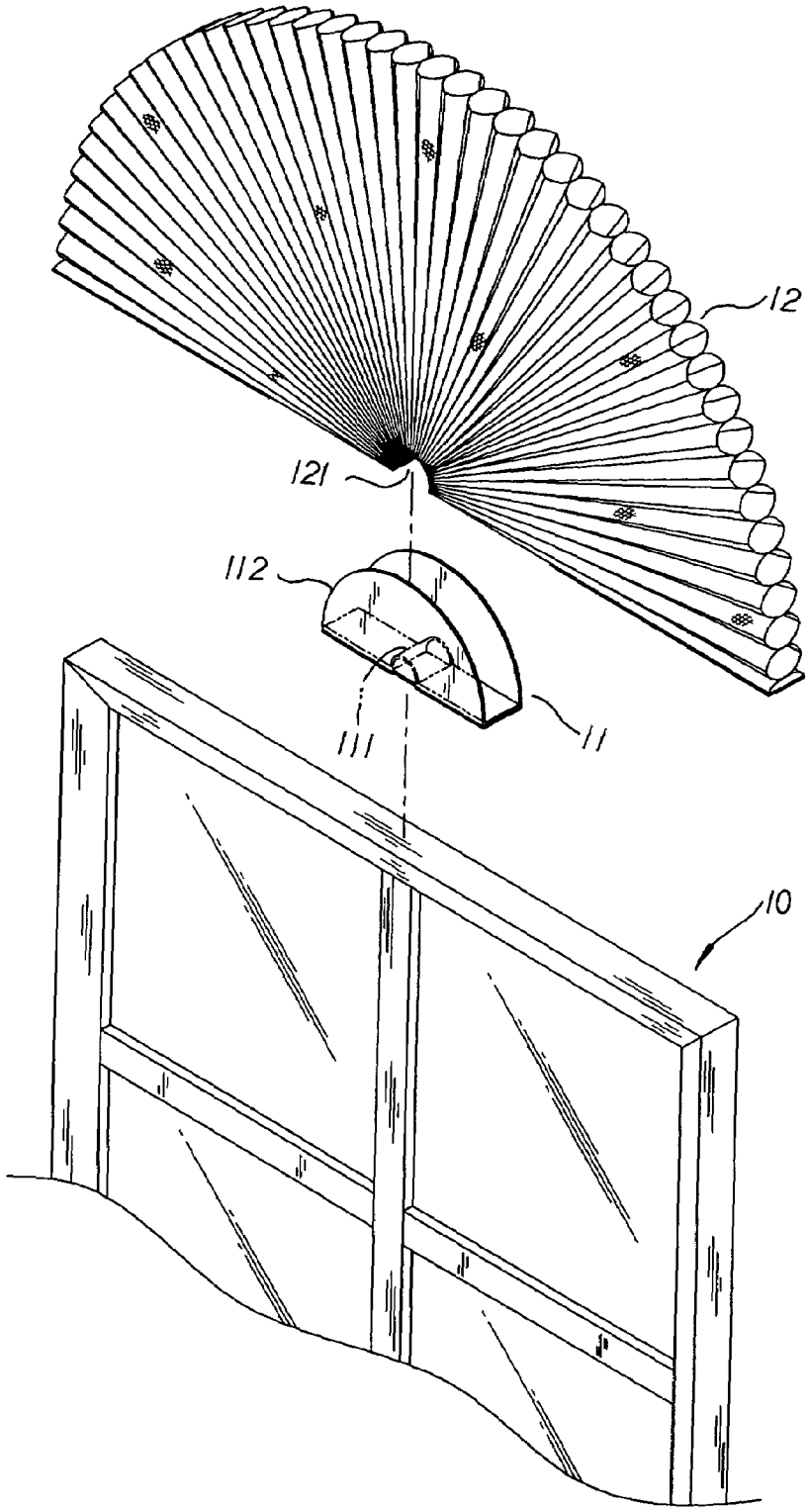
FIG. 1 PRIOR ART
FIG. 1 is an exploded perspective view of a conventional door/window ornamental article positioning structure.
Figure 2:
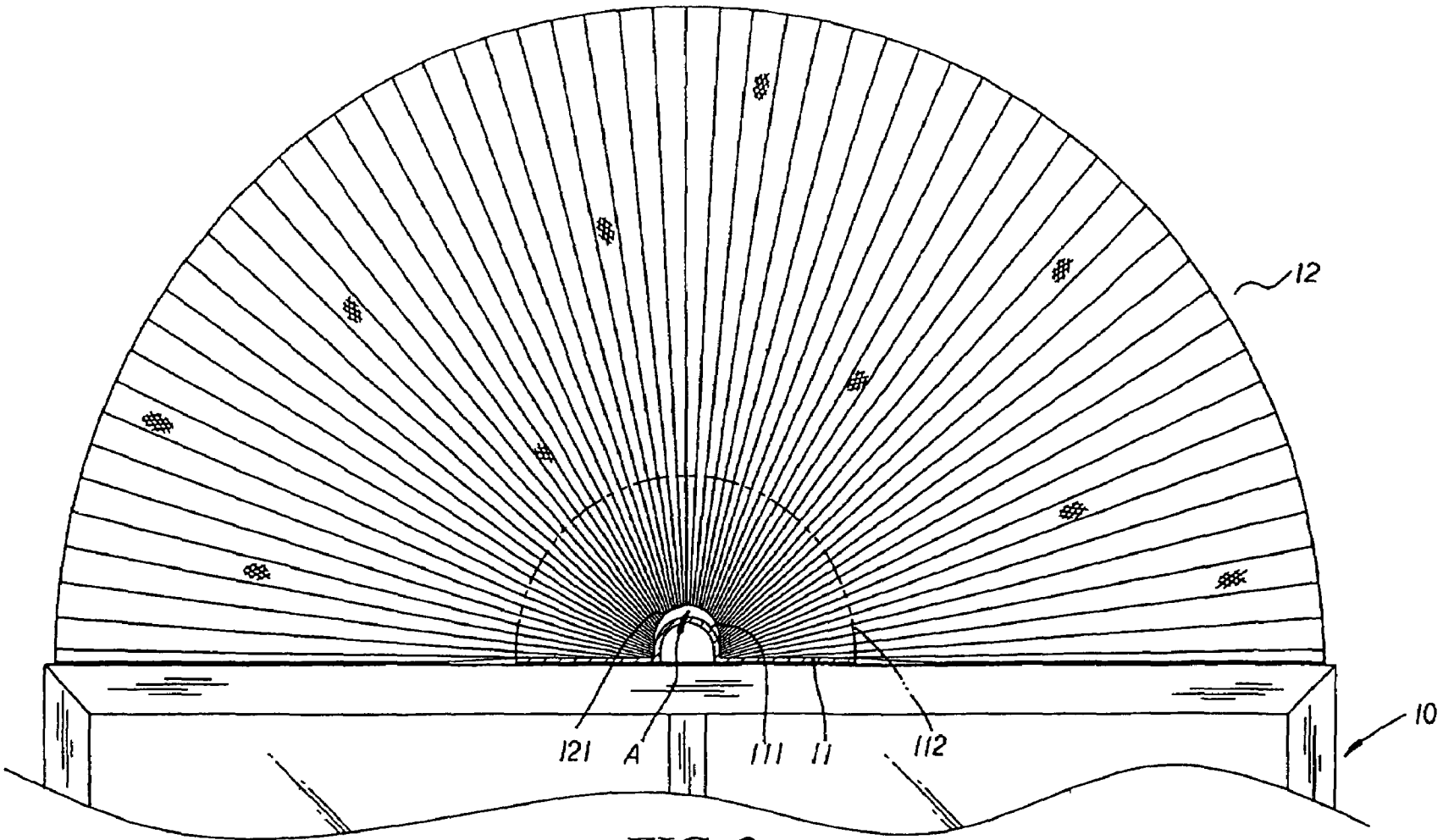
FIG. 2 PRIOR ART
FIG. 2 is an assembled cross sectional view of the conventional door/window ornamental article positioning structure with a gap revealed between a central hollow-out portion and an unfit arcuate support portion of a support mount.
Figure 3:
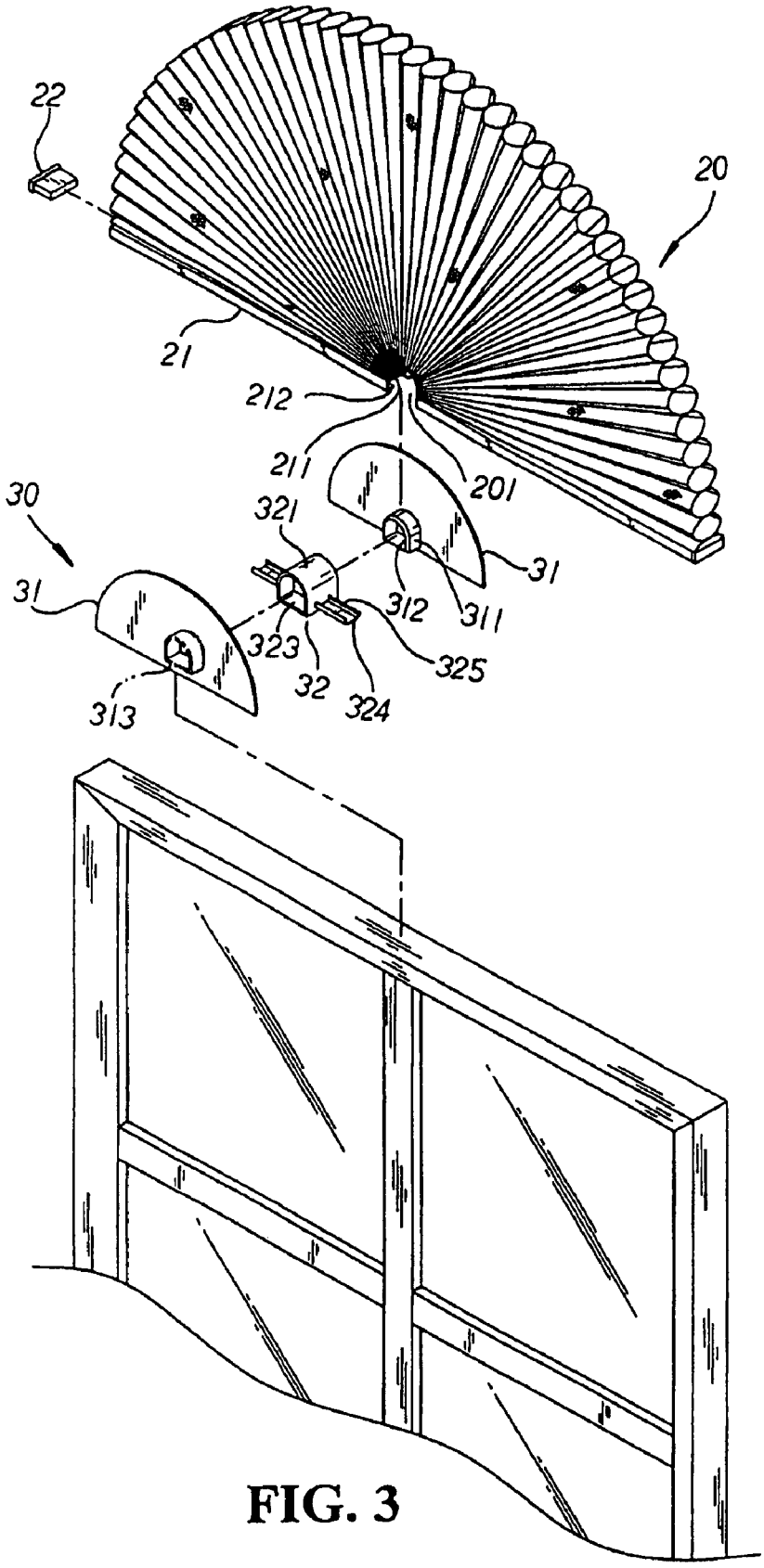
FIG. 3 is an exploded perspective view of the present invention.
Figure 4:
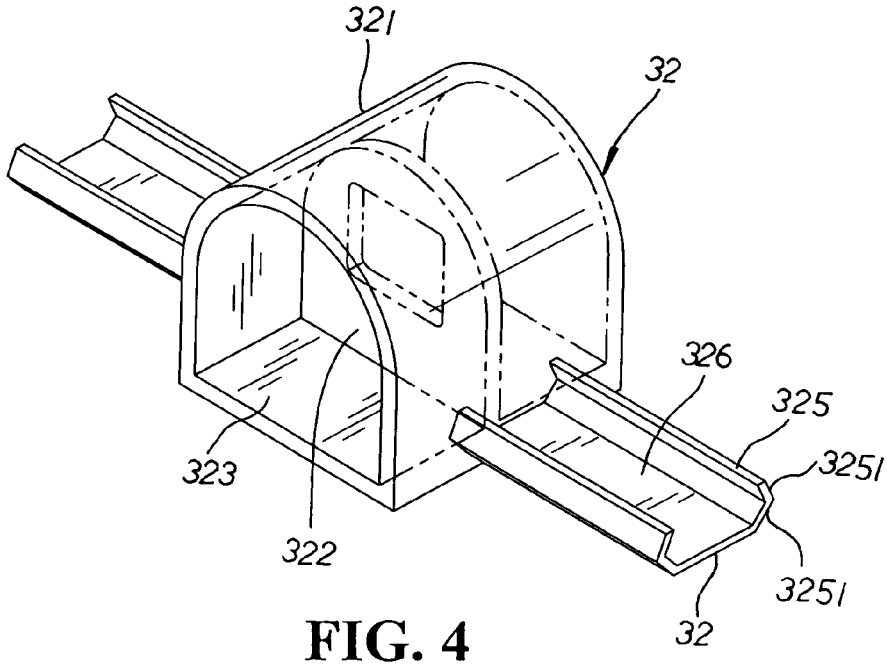
FIG. 4 is a perspective view of a support mount of the present invention.

Please refer to FIG. 3 showing an exploded perspective view of the present invention. The present invention relates to a door and window ornamental article positioning device, comprising a fan-shaped blind body 20 and a support unit 30 wherein both end undersides of the fan-shaped blind body 20 have a counterweight board 21 fixedly attached thereon respectively so that the fan-shaped blind body 20 affected by the weight of the counterweight boards 21 can be naturally expanded at both sides and positioned into a fan-like configuration thereby. The underside of the counterweight board 21 has an inverted U-shaped recessed groove 211 defining thereon, and perpendicular to both side edges of the recessed groove 211 are disposed a set of flexible insert pieces 212 symmetrically extending inwards thereon. And an enclosure sheath 22 is mounted to the outer side of each counterweight board 21 thereon. The support unit 30 is composed of two stop plates 31 and a support mount 32. Each stop plate 31, shaped in a fan-like configuration, is equipped with a hollow and arched connecting portion 311 protruding at one side thereon. The connecting portion 311 has a sloped guide surface 312 obliquely cut at one end edge thereon, and a conjoining space 313 is appropriately revealed between the stop plate 31 and the bottom surface of the connecting portion 311 thereof. The support mount 32, referring to FIG. 4, is made up of an arch-shaped arcuate support portion 321 whose curvature can be determined by the various circumferential sizes of a central hollow-out portion 201 revealed in the middle of the fan-shaped blind body 20 thereon. The arcuate support portion 321 has a hollow and arched interior with a dividing plate 322 situated in the middle to form a coupling cavity 323 at both sides of the dividing plate 322 respectively to engage with the connecting portion 311 of the stop plate 31 thereby. In addition, the support mount 32 also has a pair of wing panels 324 symmetrically protruding at both external side surfaces of the arcuate support portion 321 thereon wherein each wing panel 324 is equipped with a set of insert hooks 325 extending at both sides of the top surface thereon, and the insert hooks 325 are symmetrically bent into a pair of transverse V-shaped pieces each having a sliding guide facet 3251 formed at the upper and lower surfaces thereon respectively, permitting a flexible space 326 to form between the two insert hooks 325 of the wing panel 324 thereby.

Figure 5:
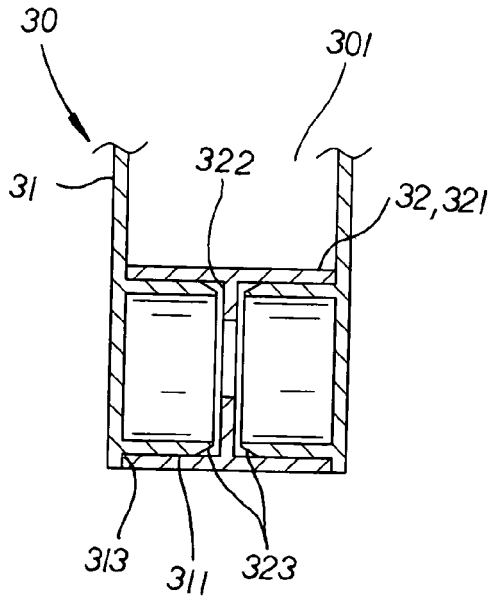
FIG. 5 is an assembled cross sectional view of a support unit of the present invention.
Figure 6:
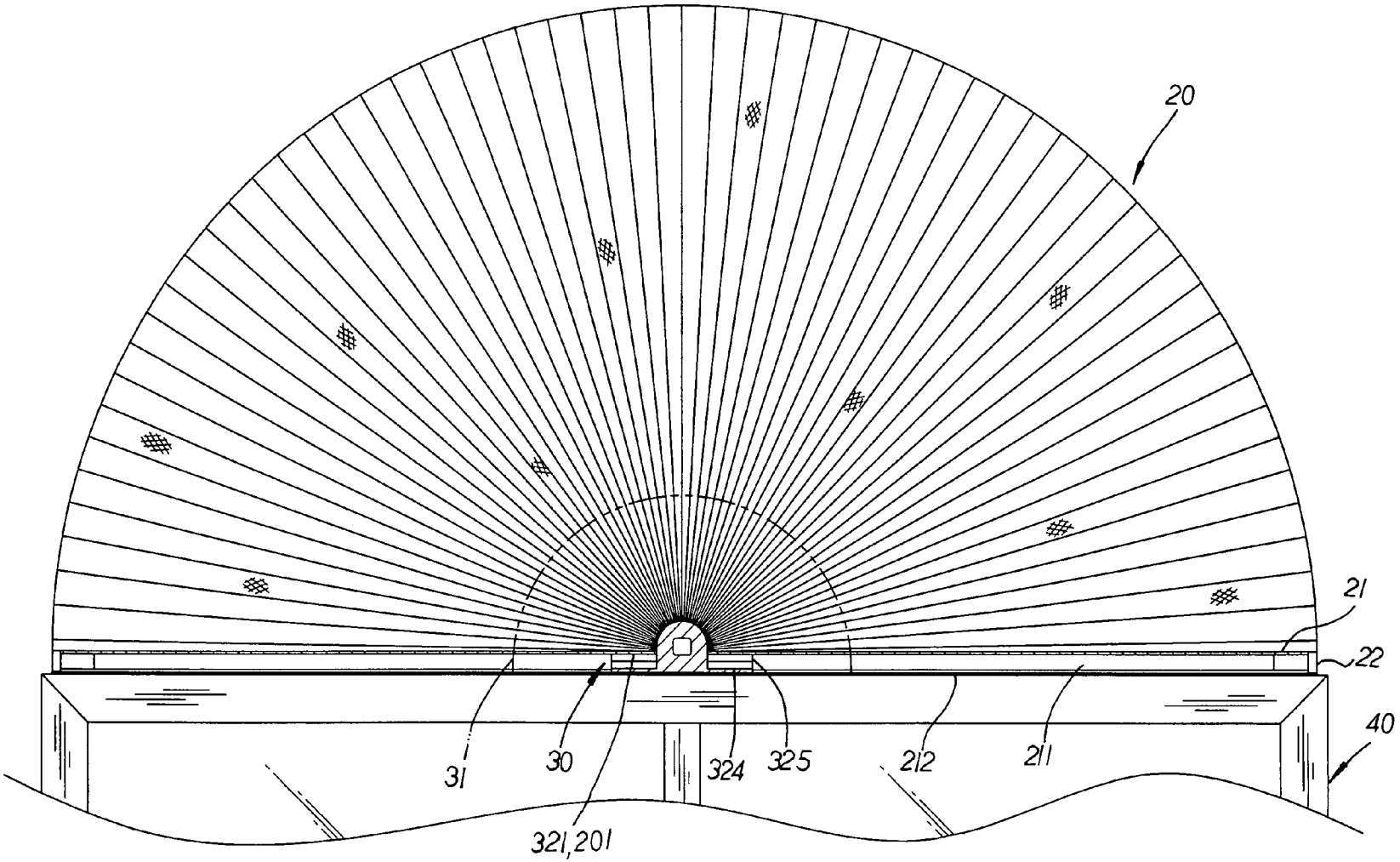
FIG. 6 is an assembled cross sectional view of the present invention.
Figure 7:
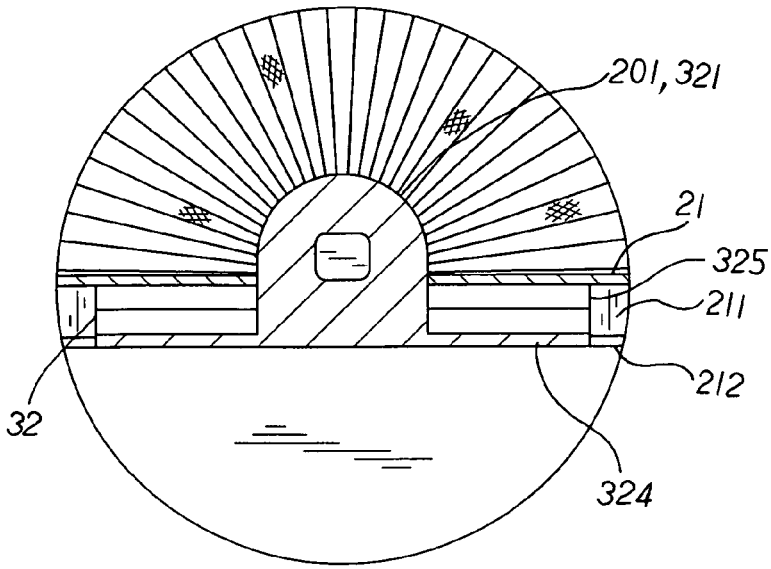
FIG. 7 is a partially enlarged and assembled cross sectional view of the present invention.
Figure 8:
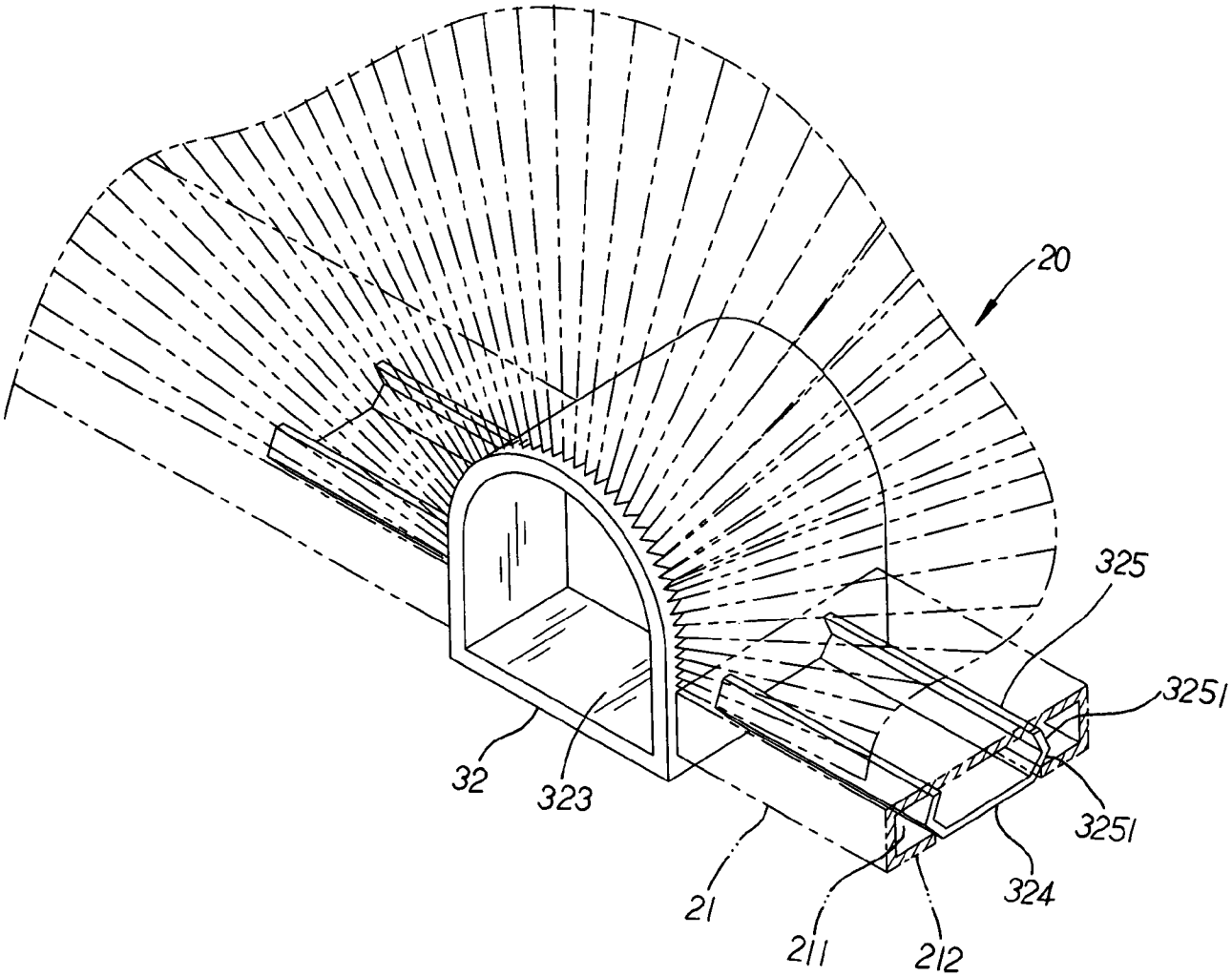
FIG. 8 is a diagram showing the support mount assembled onto a fan-shaped blind body of the present invention.

Please refer to FIG. 5. In assembly, the sloped guide surfaces 312 defining the end edges of the connecting portions 311 of both stop plates 31 are respectively guided to accommodate into the coupling cavities 323 disposed at both sides of the support mount 32, permitting the end edges of the coupling cavities 323 to precisely abut against the stop plates 31 and accurately contact with the conjoining spaces 313 so as to maintain an even and neat surface with the stop plates 31 and form a restricting space 301 thereby, completing the assembly of the support unit 30 thereof. Then, via double-sided adhesive tapes or fastening agent, the support unit 30 is fixedly adhered onto the top surface of a door/window frame 40 as shown in FIGS. 6, 7. Then, the fan-shaped blind body 20 is accommodated into the restricting space 301 of the support unit 30 till the central hollow-out portion 201 thereof is abutted against the arcuate support portion 321 of the support mount 32 and limited in position by the stop plates 31. Then, the counterweight boards 21 fixed at both end sides of the fan-shaped blind body 20 are precisely corresponded to the wing panels 324 thereof, and, via the design of the flexible space 326, the insert pieces 212 are guided along the upper sliding guide facets 3251 to squeeze the insert hooks 325 elastically compressing towards the flexible space 326 so as to flexibly accommodate into the recessed groove 211 thereby. And, the insert pieces 212 of the counterweight boards 21 are allowed to abut against the lower sliding guide facets 3251 of the insert hooks 325 for positioning thereby, permitting the wing panels 324 to evenly receive in the recessed groove 211 and form an even surface with the support mount 32 and the stop plates 31 respectively as shown in FIG. 8. Therefore, the counterweight boards 21 are further reinforced and stably positioned thereby without the risk of shaking so as to maintain the best state of the fan-shaped blind body 20 in application. Finally, the undersides of the counterweight boards 21 are secured to the top surface of a door/window frame 40 via double-sided adhesive tapes or fastening agent to complete the assembly of the present invention.

Figure 9:
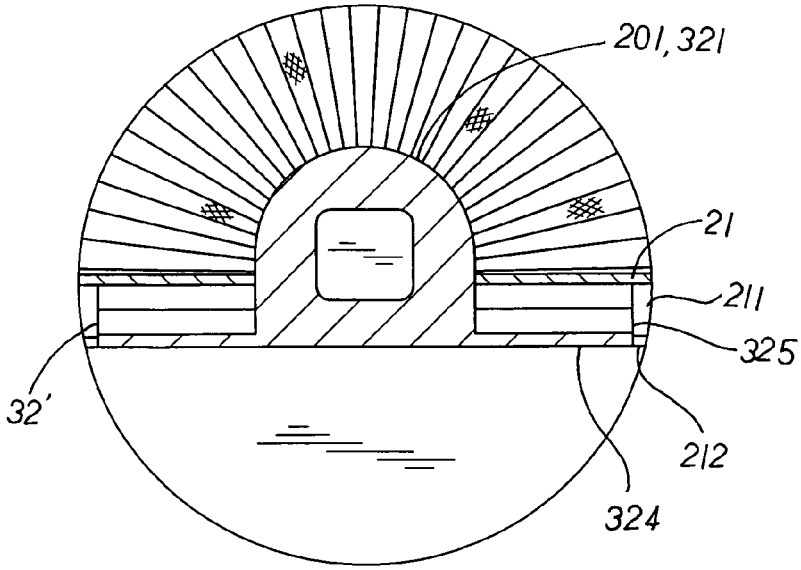
FIG. 9 is another assembled cross sectional view of the present invention.
Figure 10:
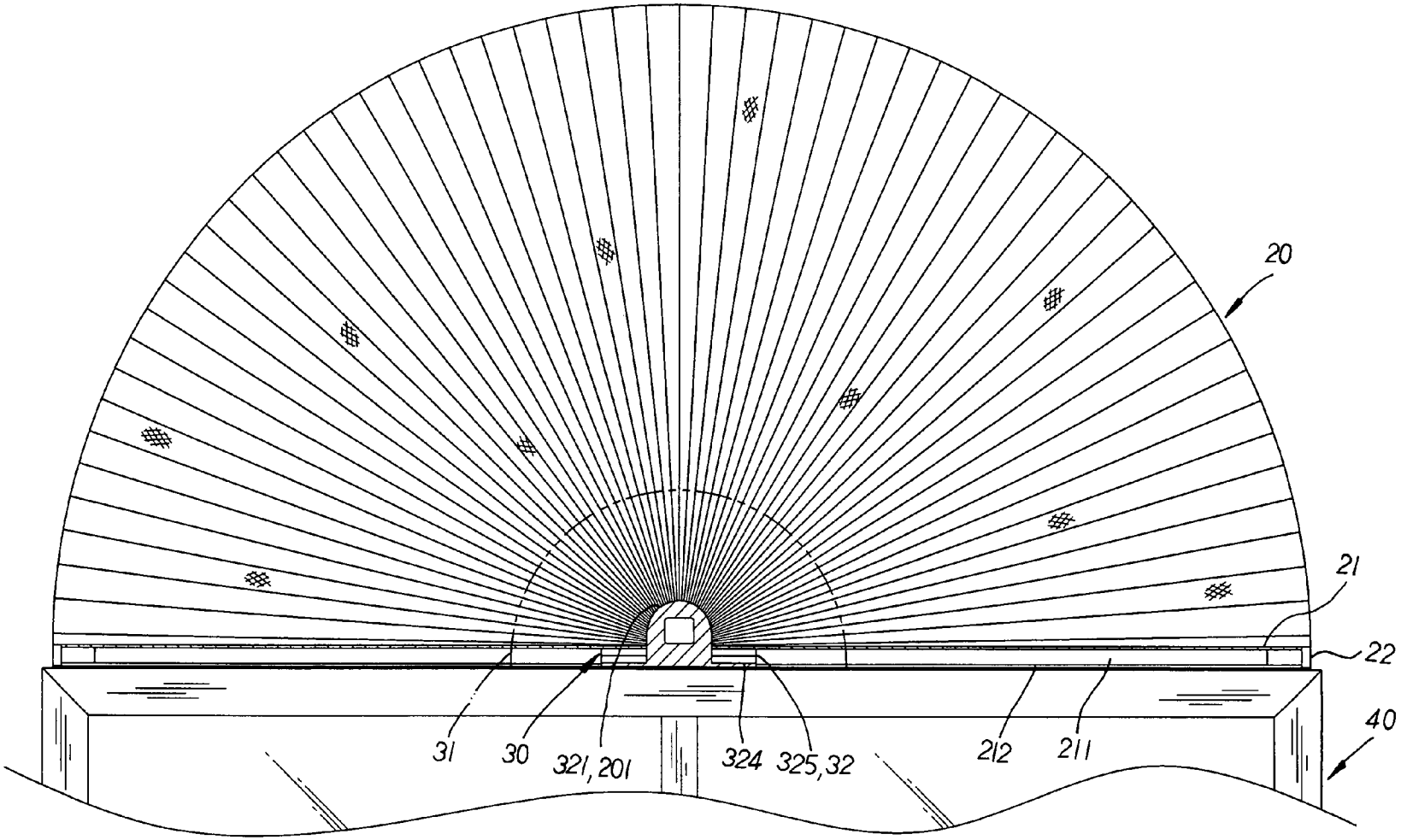
FIG. 10 is another partially enlarged and assembled cross sectional view of the present invention.

Please refer to FIGS. 9, 10. The stop plates 31 and the support mount 32 of the support unit 30 are made in a separate design so that the arcuate support portion 321 of the support mount 32 can be individually processed to fit to the various circumferential sizes of the central hollow-out portion 201 of the fan-shaped blind body 20. When the central hollow-out portion 201 of the fan-shaped blind body 20 has a larger circumference, the support unit 30 can also have another support mount 32' replaced and assembled thereto according to the diameter of the fan-shaped blind body 20. Therefore, the central hollow-out portion 201 of the fan-shaped blind body 20 can be stably positioned in place by the arcuate support portion 321 of the support mount 32' to avoid the risk of collapsing downwards, facilitating more flexible assembly and maintaining the beautiful appearance of the fan-shaped blind body 20 as a whole thereby.

What is claimed is:

1. A door and window ornamental article positioning device, comprising a fan-shaped blind body and a support unit mounted to a central hollow-out portion of the fan-shaped blind body wherein both end undersides of the fan-shaped blind body have a counterweight board with insert pieces fixedly attached thereto respectively, and the support unit is composed of two stop plates and a support mount with coupling cavities defining therein; both stop plates have a connecting portion protruding at one side thereon respectively to be mounted to the coupling cavity at both sides of the support mount, permitting both stop plates to correspond to each other with a restricting space defined there-between to position and hold the fan-shaped blind body in an expanded state; the support mount is equipped with an arcuate support portion to correspondingly fit to the hollow-out portion of the fan-shaped blind body, and a set of wing panels each having insert hooks disposed thereon is provided symmetrically extending at the both external sides of the support mount thereon to engage with the insert pieces of the counterweight boards thereby; therefore, via the separate design of the support unit with the stop plates detachably engaged with the support mount, the arcuate support portion of the support mount can be individually processed to fit to the various circumferential sizes of the central hollow-out portion of the fan-shaped blind body.

2. The door and window ornamental article positioning device as claimed in claim 1 wherein the insert hooks of the support mount are symmetrically molded into a pair of transverse V-shaped pieces each having a sliding guide facet disposed at both upper and lower surfaces thereon respectively, permitting a flexible space to form between both insert hooks thereby.

3. The door and window ornamental article positioning device as claimed in claim 1 wherein the connecting portion of the stop plate and the coupling cavity of the support mount are corresponded to each other and molded into a hollow and arcuate shape respectively.

4. The door and window ornamental article positioning device as claimed in claim 1 wherein the connecting portion of the stop plate has a sloped guide surface obliquely cut at one external end edge thereon.

5. The door and window ornamental article positioning device as claimed in claim 1 wherein the coupling cavities of the support mount have a dividing plate situated in the middle to separate the coupling cavities at both sides thereby.

6. The door and window ornamental article positioning device as claimed in claim 1 wherein the underside of the counterweight board has an inverted U-shaped recessed groove defining thereon, and the insert pieces are symmetrically arranged to extend at both side edges of the recessed groove and equipped with a flexible capacity.

7. The door and window ornamental article positioning device as claimed in claim 1 wherein the counterweight board can also have an enclosure sheath mounted to the outer end side thereon.

8. The door and window ornamental article positioning device as claimed in claim 1 wherein the stop plate is molded in a fan-shaped configuration.

* * * * *